US010855022B2

(12) United States Patent
Komori et al.

(10) Patent No.: US 10,855,022 B2
(45) Date of Patent: Dec. 1, 2020

(54) COVER-EQUIPPED CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hirokazu Komori, Mie (JP); Naomichi Kawashima, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/371,162

(22) Filed: Apr. 1, 2019

(65) Prior Publication Data

US 2019/0305477 A1 Oct. 3, 2019

(30) Foreign Application Priority Data

Mar. 30, 2018 (JP) ..... 2018-066979

(51) Int. Cl.

| | |
|---|---|
| ***H01R 13/502*** | (2006.01) |
| ***H01R 13/585*** | (2006.01) |
| ***H01R 13/56*** | (2006.01) |
| ***H01R 13/428*** | (2006.01) |
| ***H01R 13/52*** | (2006.01) |
| ***H01R 13/58*** | (2006.01) |

(52) U.S. Cl.

CPC ..... *H01R 13/585* (2013.01); *H01R 13/428* (2013.01); *H01R 13/5213* (2013.01); *H01R 13/562* (2013.01); *H01R 13/5804* (2013.01)

(58) Field of Classification Search

CPC ..... H01R 13/5812; H01R 13/516; H01R 13/506; H01R 13/5829; H01R 13/595; H01R 13/514

USPC ..... 439/460, 464, 465, 467, 470, 473, 701, 439/902, 903

See application file for complete search history.

(56) References Cited

U.S. PATENT DOCUMENTS 3,675,184 A * 7/1972 Vetter ..... H01R 13/59 439/462
5,259,785 A * 11/1993 Inaba ..... H01R 13/58 439/364
5,391,092 A * 2/1995 Sumida ..... H01R 13/516 439/470
5,672,078 A * 9/1997 Fukamachi ..... H01R 13/518 439/701
5,688,144 A * 11/1997 Kosuge ..... H01R 13/516 439/596
5,709,560 A * 1/1998 Hio ..... H01R 13/62933 439/157

(Continued)

FOREIGN PATENT DOCUMENTS

JP 2017-033851 2/2017

*Primary Examiner* — Thanh Tam T Le

(74) *Attorney, Agent, or Firm* — Gerald E. Hespos; Michael J. Porco; Matthew T. Hespos

(57) ABSTRACT

A connector (10) includes a connector housing (12) fittable to a mating connector (11), a wire cover (14) disposed at a position spaced apart rearward from the connector housing (12) in a fitting direction to the mating connector (11) and configured to cover wires (13) drawn out rearward in the fitting direction from the connector housing (12), and a service cover (15) assembled over the connector housing (12) and the wire cover (14).

9 Claims, 12 Drawing Sheets

(56) References Cited

U.S. PATENT DOCUMENTS

| | | | | | |
|---|---|---|---|---|---|
| 5,725,397 | A * | 3/1998 | Fukamachi | H01R 13/514 | 439/701 |
| 5,971,791 | A * | 10/1999 | Itoh | H01R 13/5202 | 439/364 |
| 6,139,372 | A * | 10/2000 | Yang | G06F 1/189 | 439/660 |
| 6,155,884 | A * | 12/2000 | Sugiyama | H01R 13/516 | 439/701 |
| 7,182,626 | B2 * | 2/2007 | Langolf | H01R 13/506 | 439/473 |
| 7,201,609 | B2 * | 4/2007 | Ishikawa | H01R 13/5219 | 439/157 |
| 7,275,955 | B2 * | 10/2007 | Ko | H01R 12/592 | 439/498 |
| 7,422,470 | B2 * | 9/2008 | Tsuji | H01R 13/56 | 439/470 |
| 7,507,125 | B2 * | 3/2009 | Okamura | H01R 13/506 | 439/680 |
| 8,926,378 | B2 * | 1/2015 | Tanimura | H01R 13/629 | 439/701 |
| 10,063,007 | B2 * | 8/2018 | Sugimoto | H01R 13/5812 | |

* cited by examiner

COVER-EQUIPPED CONNECTOR

BACKGROUND

Field of the Invention

This specification relates to a cover-equipped connector with a cover for covering a wire.

Related Art

Japanese Unexamined Patent Publication No. 2017-33851 discloses a cover-equipped connector to be disposed in a vehicle or the like. Wires are drawn out rearward from a rear end part of this cover-equipped connector, and a wire cover is mounted on the rear part of the cover-equipped connector for covering the wires.

The wire cover is engaged with the rear part of the cover-equipped connector and has two half covers assembled with each other. The half covers are assembled by locking engaging projections on one half cover and engaging pieces on the other half cover.

Maintenance of the cover-equipped connector requires a part of the cover-equipped connector where the wires are drawn out to be exposed to specify a terminal required to be repaired and to pull this terminal from the cover-equipped connector. This exposure requires the wire cover to be removed from the rear part of the cover-equipped connector so that a worker can access the part of the cover-equipped connector where the wires are drawn out. Thus, the engaging projections and the engaging pieces need to be unlocked from each other to disassemble the wire cover. The wire cover extends relatively long in an extending direction of the wires so that the wire cover can protect the wires. Therefore, the numbers of the engaging projections and the engaging pieces for assembling the half covers of the wire cover with each other also tends to be relatively large. As a result, the operation of disassembling the wire cover is cumbersome during a maintenance operation.

This specification was completed on the basis of the above situation and aims to provide a cover-equipped connector with improved maintainability.

SUMMARY

A cover-equipped connector disclosed in this specification includes a connector housing fittable to a mating connector. A wire cover is disposed at a position spaced rearward from the connector housing in a fitting direction to the mating connector and is configured to cover a wire drawn out rearward in the fitting direction from the connector housing. A service cover assembled over the connector housing and the wire cover.

According to this configuration, the wire cover is spaced rearward from the connector housing in the fitting direction. Thus, a part of the connector housing where the wire is drawn out can be exposed by removing the service cover from the connector housing. Since it is possible to save time and effort of disassembling the wire cover during maintenance in this way, the maintenance of the cover-equipped connector is facilitated.

The connector housing includes an inner housing to be fit into the mating connector and an outer housing to be fit externally to the mating connector. The outer housing includes a first locking portion to be locked to the inner housing and a second locking portion to be locked to the mating connector. According to this configuration, the following functions and effects can be achieved. First, the connector housing is formed by locking the outer housing and the inner housing by the first locking portion. The connector housing in this state and the mating connector are fit. At this time, the mating connector and the outer housing are locked by the second locking portion and the outer housing is fit externally to the mating connector. In this way, the connector housing and the mating connector are fit.

Subsequently, during a maintenance operation, locking between the first locking portion of the outer housing and the inner housing is released. The inner housing then is separated from the mating connector and the outer housing. In this way, a fitting state between the outer housing and the mating connector can be maintained during the maintenance operation. This can suppress a performance (e.g. sealing) reduction of the cover-equipped connector due to the separation of the outer housing and the mating connector. As a result, it is not necessary to pay attention to the performance reduction of the cover-equipped connector during the maintenance operation. Therefore the efficiency of the maintenance of the connector is improved.

After a repair operation is finished, the inner housing is fit into the mating connector and the inner housing and the outer housing are locked by the first locking portion. At this time, the fitting state is maintained between the mating connector and the outer housing. Thus, the performance reduction of the connector can be suppressed before and after the maintenance operation. As a result, when the connector housing and the mating connector are fit again, it is not necessary to pay attention to the performance reduction of the connector so that maintenance of the cover-equipped connector can be facilitated.

The service cover may include a first surrounding wall configured to cover the first locking portion with the service cover assembled over the connector housing and the wire cover. According to this configuration, it is possible to suppress the separation of the inner housing and the outer housing due to the contact of external matter with the first locking portion. On the other hand, the first locking portion can be exposed easily by removing the service cover during maintenance. In this way, a worker can separate the inner housing from the outer housing by operating the first locking portion to unlock the inner housing and the outer housing.

The service cover may include a second surrounding wall configured to cover the second locking portion with the service cover assembled over the connector housing and the wire cover. An unlocking hole may penetrate through the second surrounding wall so that the second locking portion can be unlocked. According to this configuration, a locking structure of the mating connector and the outer housing can be unlocked without removing the service cover.

The cover-equipped connector may include a water stop that includes a rubber plug having a wire through hole. The wire is inserted through the wire through hole. A cap may be fit externally to the rubber plug, and the water stop may be mounted in the wire cover. According to this configuration, the wire can be sealed reliably in the wire cover. Further, sealing is not reduced by contact of another member or the like with the water stop.

The service cover may be formed by locking a service cover locking portion on one of first and second service covers and a service cover lock receiving portion provided on the other to assemble the first and second service covers. Accordingly, the service cover can be removed easily from the connector housing by unlocking the locking structure of the service cover locking portion and the service cover lock receiving portion. In this way, the maintenance of the cover-equipped connector can be facilitated further.

A shaft may project out on an outer wall of the first service cover, and the second service cover may have a bearing portion to be engaged with the shaft and is rotatable about the shaft with the locking structure of the service cover locking portion and the service cover lock receiving portion unlocked. Accordingly, to the above configuration, by rotating the second service cover about the shaft portion after the locking structure of the service cover locking portion and the service cover lock receiving portion is unlocked, a separating structure for separating the wire cover from the connector housing can be exposed. Since the first and second service covers need not be divided in this way, components can be managed easily during the maintenance operation. In this way, the maintenance of the cover-equipped connector can be improved.

According to this specification, it is possible to improve the maintainability of a cover-equipped connector.

DETAILED DESCRIPTION

First Embodiment

Figure 1:
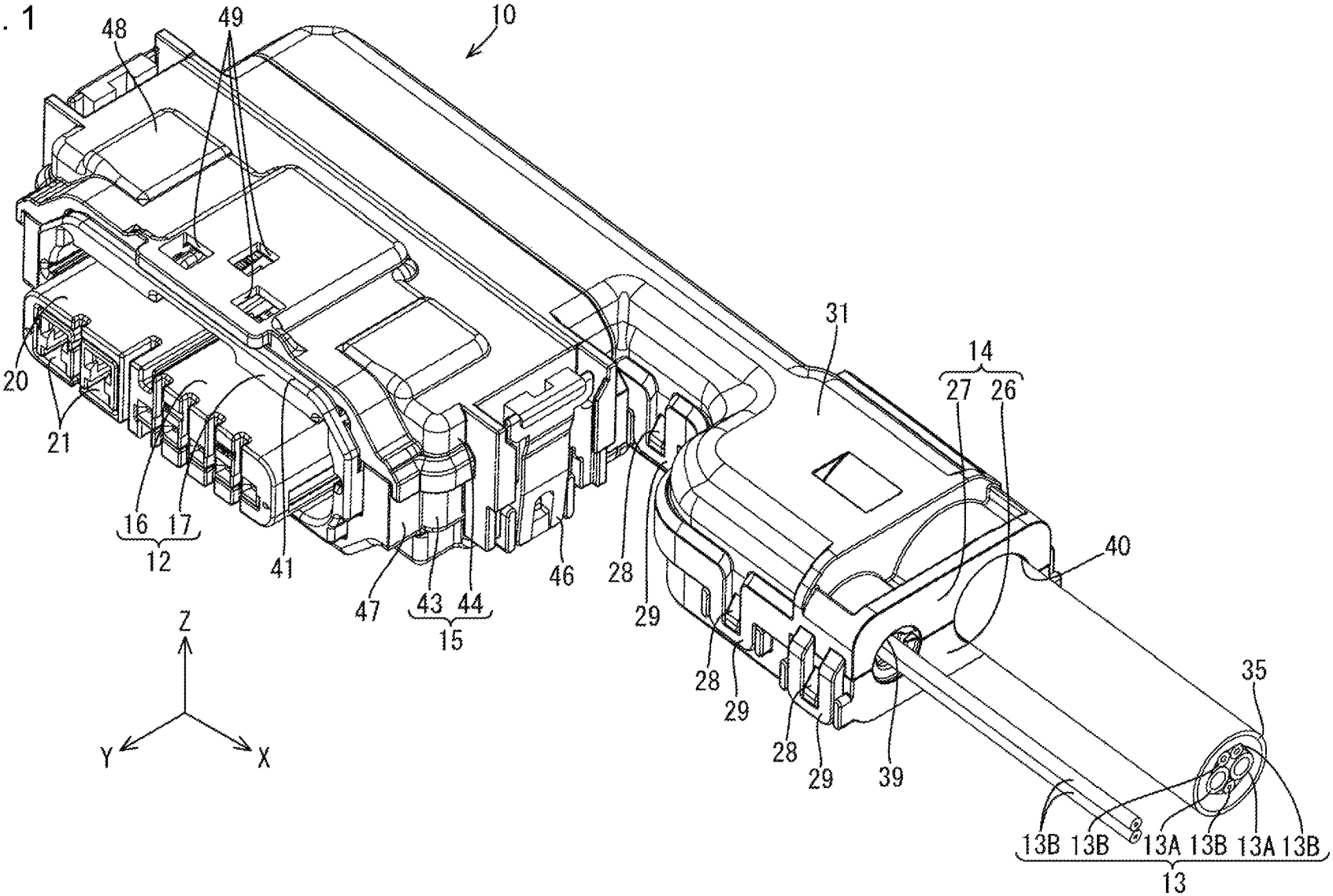
FIG. 1 is a perspective view of a connector according to a first embodiment.
Figure 2:
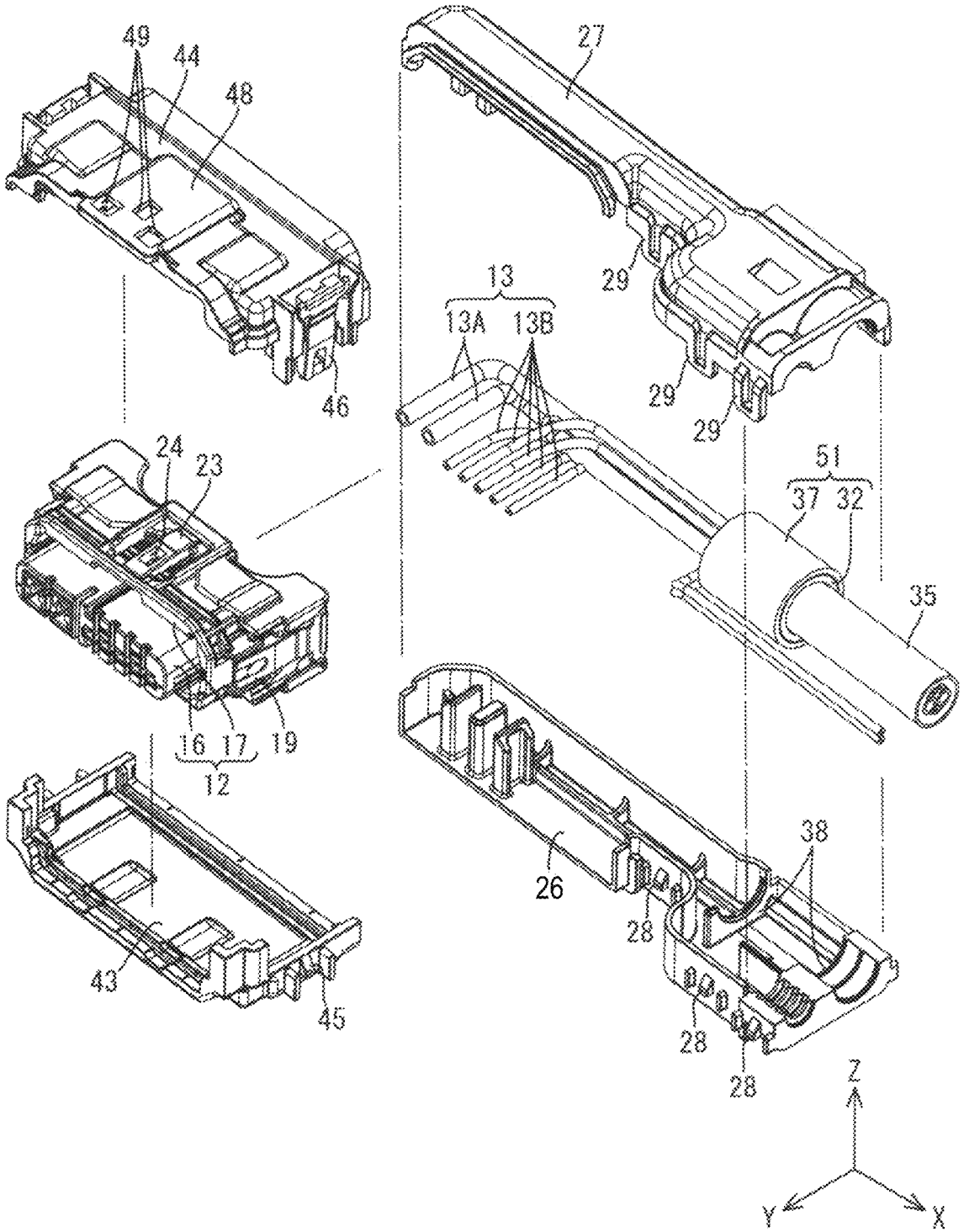
FIG. 2 is an exploded perspective view showing the connector.
Figure 3:
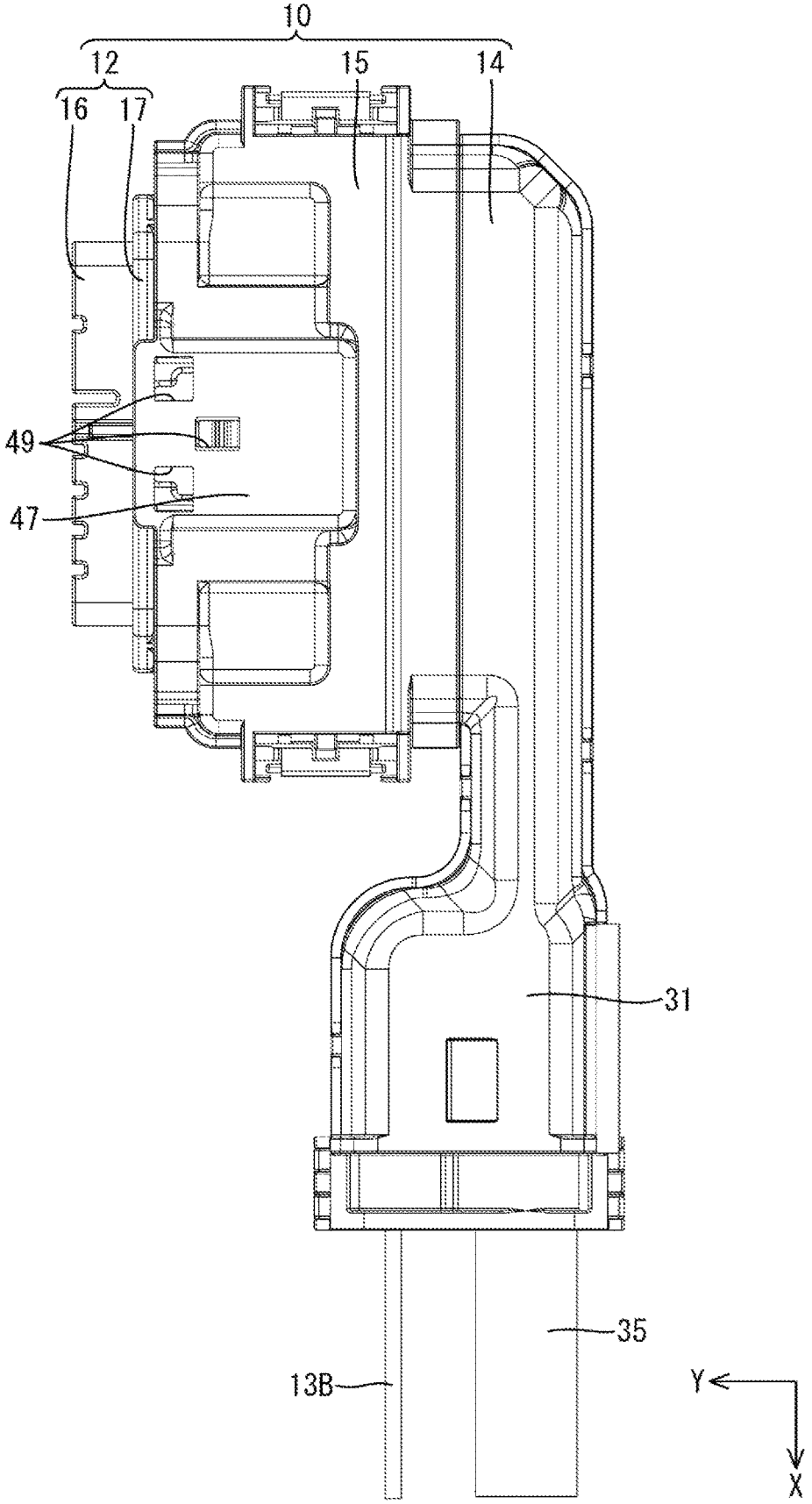
FIG. 3 is a plan view showing the connector.
Figure 4:
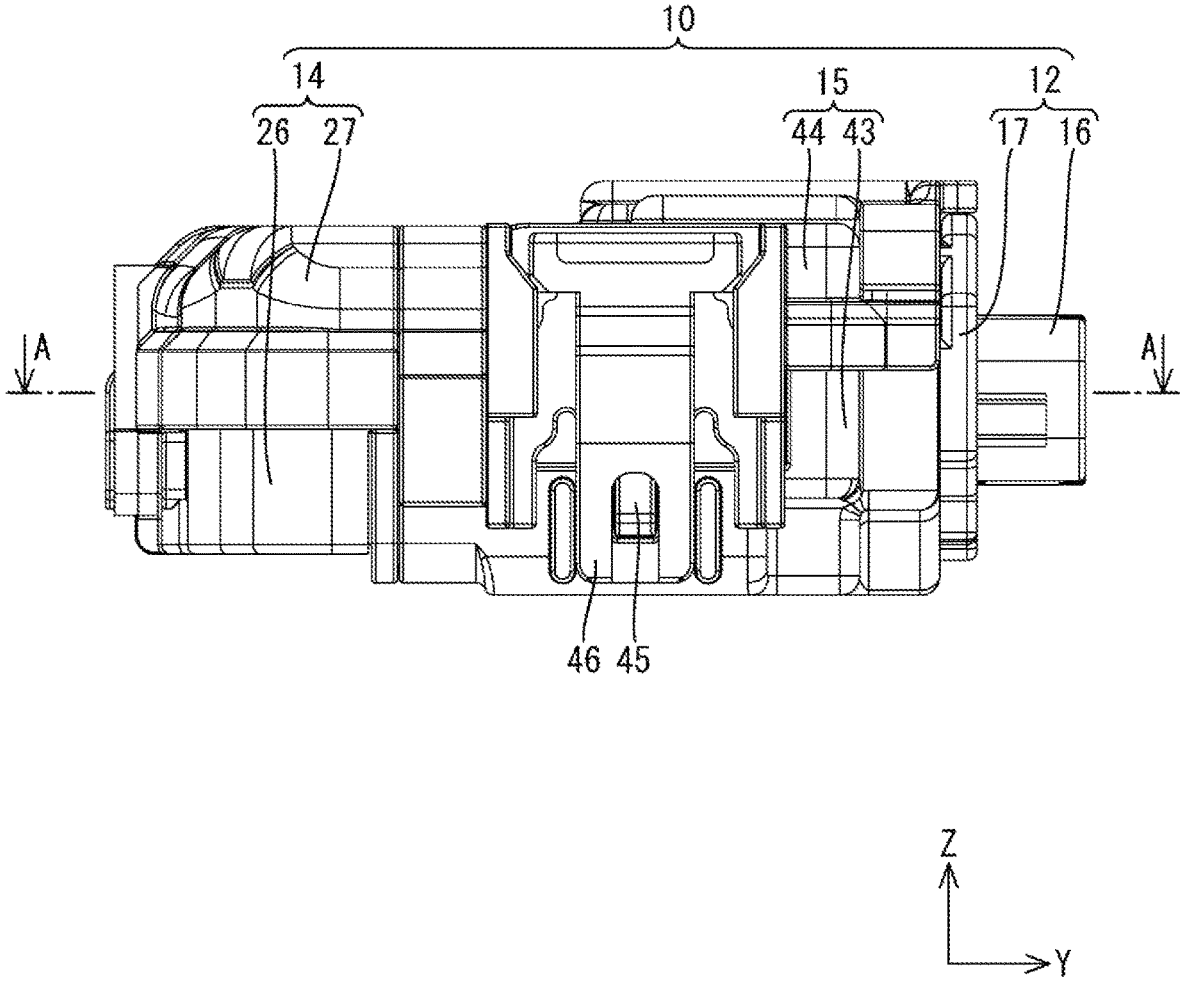
FIG. 4 is a right side view showing the connector.
Figure 5:
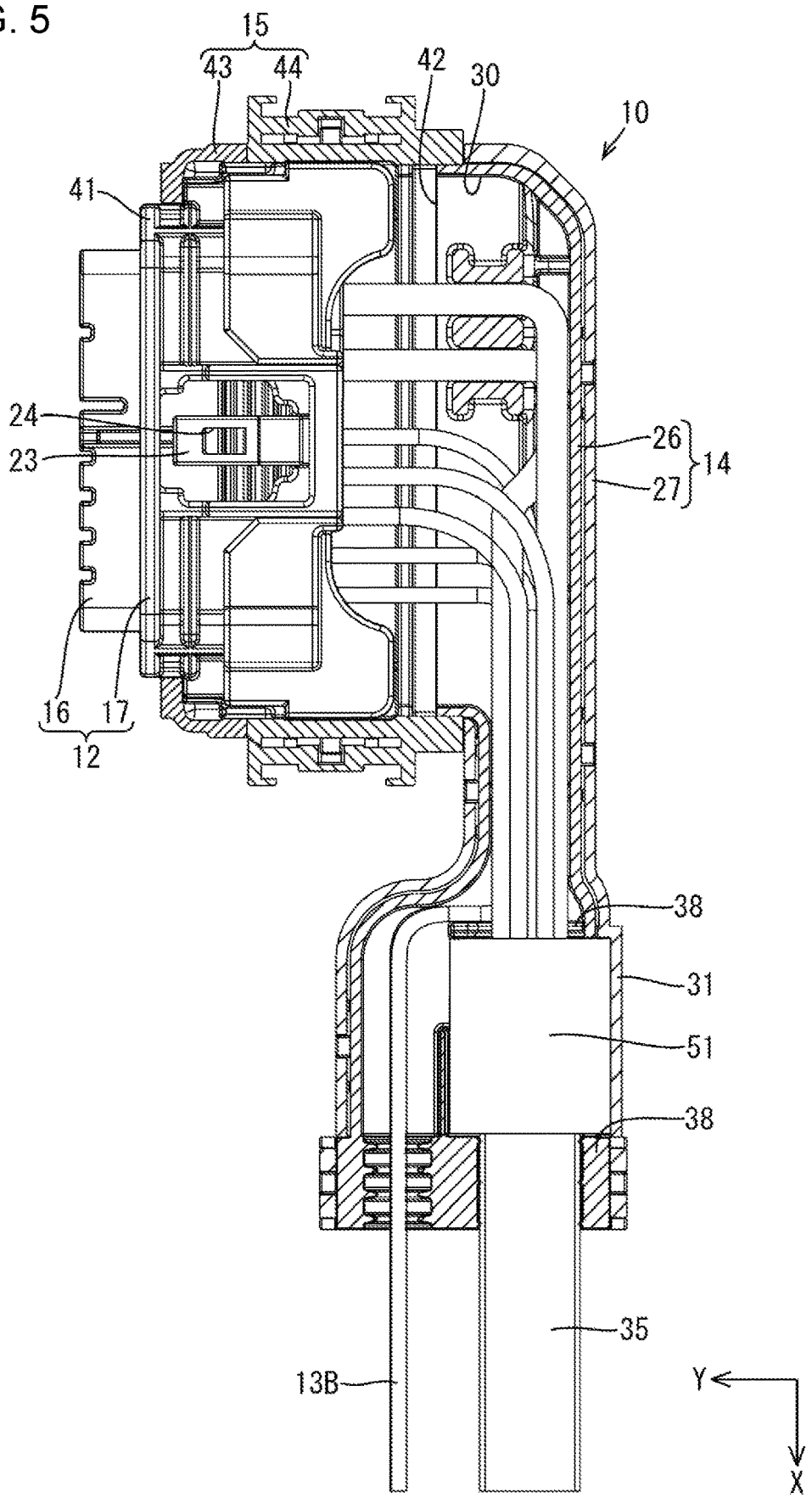
FIG. 5 is a section along A-A in FIG. 5.

A first embodiment of the invention is described with reference to FIGS. 1 to 8. A cover-equipped connector 10 according to this embodiment is used, for example, in an environment where external matter is present, such as the periphery of a tire of an unillustrated vehicle. Note that, in the following description, a Z direction is an upward direction, a Y direction is a forward direction and an X direction is a leftward direction. Further, only one member may be denoted by a reference sign and the other members may not be denoted by the reference sign for a plurality of identical members in some cases.

Connector 10

The connector 10 is connected electrically to a mating connector 11 by being fit to the mating connector 11 along a front-rear fitting direction. The connector 10 includes a connector housing 12, a wire cover 14 for covering wires 13 (seven in this embodiment) drawn out rearward from the connector housing 12, and a service cover 15 mounted over the connector housing 12 and the wire cover 14.

Connector Housing 12

The connector housing 12 includes an inner housing 16 and an outer housing 17 disposed on an outer peripheral side of the inner housing 16. The inner housing 16 is fit into the mating connector 11, and the outer housing 17 is fit externally to the mating connector 11.

First locking portions 18 project out on the outer surfaces of both left and right side walls of the outer housing 17. The outer housing 17 and the inner housing 16 are assembled by resiliently locking the first locking portions 18 and first lock receiving portions 19 formed at positions of the inner housing 16 corresponding to the first locking portions 18.

The inner housing 16 includes a vertically flat terminal accommodating portion 20 extending in the front-rear direction. Cavities 21 for accommodating unillustrated terminals are formed in the terminal accommodating portion 20 and extend in the front-rear direction. The cavities 21 are open forward and rearward. The wires 13 connected to the terminals are drawn out rearward from rear parts of the cavities 21. The terminal connected to an end of each wire 13 is retained in the cavity 21 by a known structure, such as a locking lance.

The first lock receiving portions 19 are provided on both left and right side walls of the terminal accommodating portion 20 extending in the front-rear direction. The first lock receiving portions 19 have a U-shaped front end when viewed from the front.

A seal ring 22 made of rubber is fit externally near a center position in the front-rear direction on the outer surface of the terminal accommodating portion 20.

The outer housing 17 is formed into a tubular shape penetrating in the front-rear direction, and the inner housing 16 is inserted into the outer housing 17 from behind.

A second locking portion 23 is formed on an upper wall of the outer housing 17 and is to be locked to the mating connector 11. The second locking portion 23 is in the form of a plate extending in the front-rear direction, and is formed with a through hole 24 extending in the vertical direction at a position near a front part. A second lock receiving portion (not shown) of the mating connector 11 is fit into this through hole 24 so that the outer housing 17 and the mating connector 11 are assembled in a retained state.

The terminal accommodating portion 20 of the inner housing 16 projects forward from the front edge of the outer housing 17 when the inner housing 16 and the outer housing 17 are assembled. The mating connector 11 is fit to the connector housing 12 from the front with the inner housing 16 and the outer housing 17 assembled. Thus, the inner housing 16 is fit into the mating connector 11 and the outer housing 17 is fit externally on the mating connector 11. The seal ring 22 that is fit externally on the terminal accommodating portion 20 of the inner housing 16 is held in close contact with the mating connector 11. In this way, the inner housing 16 and the mating connector 11 are sealed in a liquid-tight manner.

Wire Cover 14

The wires 13 drawn out rearward from the rear end part of the connector housing 12 are bent left substantially at a right angle to extend leftward after temporarily extending rearward. The wire cover 14 is elongated in a lateral direction and covers the wires 13. The wire 14 is disposed at a position behind the connector housing 12 and somewhat spaced apart from the connector housing 12.

The wire cover 14 includes an upwardly open first wire cover 26, and a second wire cover 27 is assembled with the first wire cover 26 to cover an opening of the first wire cover 26. Wire cover locks 28 project out on a side wall of the first wire cover 26, and wire cover lock receiving portions 29 are formed on a side wall of the second wire cover 27 at positions corresponding to the wire cover locks 28. The wire cover lock receiving portions 29 are U-shaped when viewed laterally. The first and second wire covers 26, 27 are assembled by resiliently locking the wire cover lock receiving portions 29 to the wire cover locks 28.

With the first and second wire covers 26, 27 assembled, a forwardly open wire introduction port 30 is formed substantially in a right half area of a front wall of the wire cover 14. The wires 13 drawn out from the connector housing 12 are introduced into the wire cover 14 through this wire introduction port 30.

A branched portion 31 is provided at a position of the wire cover 14 near a left end part and is widened in the front-rear direction. The wires 13 are branched in the branched portion 31 into those disposed on a front side of the branched portion 31 and those disposed on a rear side of the branched portion 31.

The wires 13 include two large-diameter wires 13A and three small-diameter wires 13B are routed on the rear side of the branched portion 31, and two additional small-diameter wires 13B are routed on the front side of the branched portion 31.

A rubber plug 32 is fit externally to the wires 13 disposed on the rear side of the branched portion 31. A substantially right half of the rubber plug 32 serves as a wire insertion portion 34 including wire through holes 33 (five in this embodiment) through which each of a plurality of wires 13 is inserted. A substantially left half of the rubber plug 32 serves as a sheath external fitting portion 36 to be fit externally to a sheath 35 made of synthetic resin and collectively surrounding the five wires 13.

A cap 37 made of synthetic resin and having a hollow cylindrical shape penetrating in the lateral direction is externally fit on the outer periphery of the rubber plug 32. The cap 37 is fit over the rubber plug 32 and presses the rubber plug 32 radially inward. Thus, the wires 13 and the rubber plug 32 are sealed in a liquid-tight manner. A water stop 51 is constituted by the cap 37 and the rubber plug 32.

Holding walls 38 rise vertically on the rear side of the branched portion 31 and hold the cap 37 from front and rear sides. The cap 37 is held in the wire cover 14 by these holding walls 38.

With the first and second wire covers 26, 27 assembled, a small-diameter draw-out port 39 from which two wires 13 are drawn out and a large-diameter draw-out port 40 from which the five wires 13 surrounded by the sheath 35 are drawn out are open leftward in the left end part of the wire cover 14. The small-diameter draw-out port 39 is provided on a front side of the wire cover 14 and the large-diameter draw-out port 40 is provided on a rear side of the wire cover 14.

Service Cover 15

The service cover 15 is mounted on the connector housing 12 and the wire cover 14 from a part of the connector housing 12 somewhat behind a front edge 41 of the outer housing 17 to an edge 42 of the wire introduction port 30 of the wire cover 14. In this way, the service cover 15 covers a part of the connector housing 12 behind the front edge 41 of the outer housing 17 and a part of the wire cover 14 in front of the edge 42 of the wire introduction port 30 from outside.

The service cover 15 includes an upwardly open first service cover 43 and a second service cover 44 to be assembled with the first service cover 43 from above. With the first and second service covers 43, 44 assembled, the service cover 15 is formed into a tubular shape penetrating in the front-rear direction.

Service cover locks 45 project out from the outer surfaces of both left and right walls of the first service cover 43. Service cover lock receiving portions 46 extend down at positions corresponding to the service cover locks 45 on both left and right walls of the second service cover 44. The service cover lock receiving portions 46 are U-shaped when viewed laterally. The first and second service covers 43, 44 are assembled by resiliently locking the service cover lock receiving portions 46 to the service cover locks 45.

Both left and right walls of the service cover 15 serve as first surrounding walls 47 for covering the first locks 18 and the first lock receiving portions 19. Further, an upper wall of the service cover 15 serves as a second surrounding wall 48 for covering the second lock 23 and the second lock receiving portion.

A part right above the second lock 23 and the second lock receiving portion is covered by the second surrounding wall 48. On the other hand, unlocking holes 49 having a rectangular opening when viewed from above are formed at positions somewhat deviated leftward, rightward and rearward from the part right above the second lock 23 and the second lock receiving portion. A locking structure of the second lock 23 and the second lock receiving portion can be unlocked by inserting an unillustrated tool through the unlocking hole 49. An opening area of the unlocking hole 49 is set such that the tool is insertable and the tool can be operated to an extent capable of unlocking the locking structure of the second lock 23 and the second lock receiving portion.

Example of Maintenance Operation

Next, an example of the maintenance operation of the connector 10 according to this embodiment is described. A process of the maintenance operation is not limited to the one described below.

Figure 6:
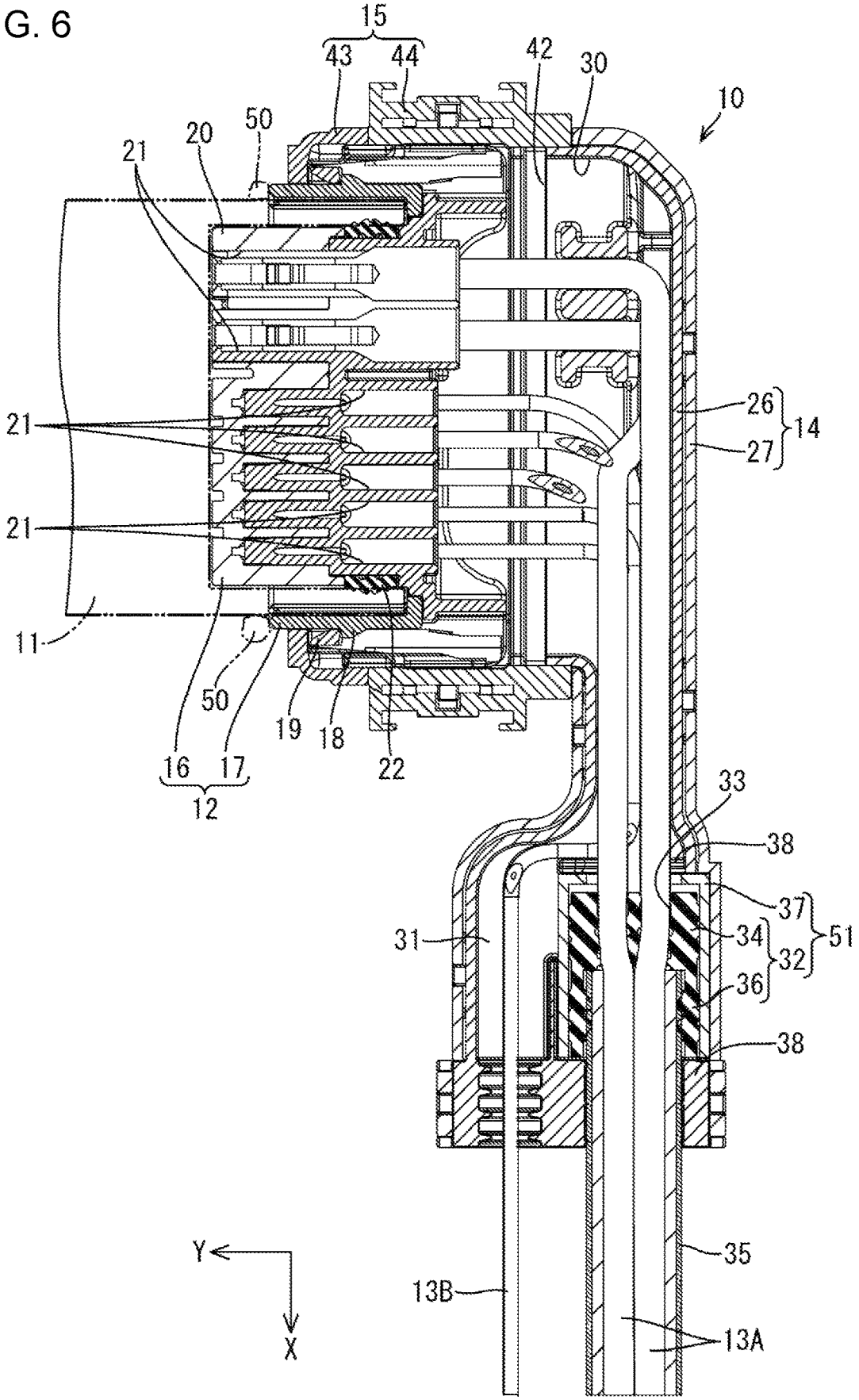
FIG. 6 is a section showing a state where a mating connector and the connector are fit.

As shown in FIG. 6, when the connector 10 and the mating connector 11 are used while being fit to each other, an external matter 50 such as mud may adhere to a boundary part between the mating connector 11 and the outer housing 17.

Figure 7:
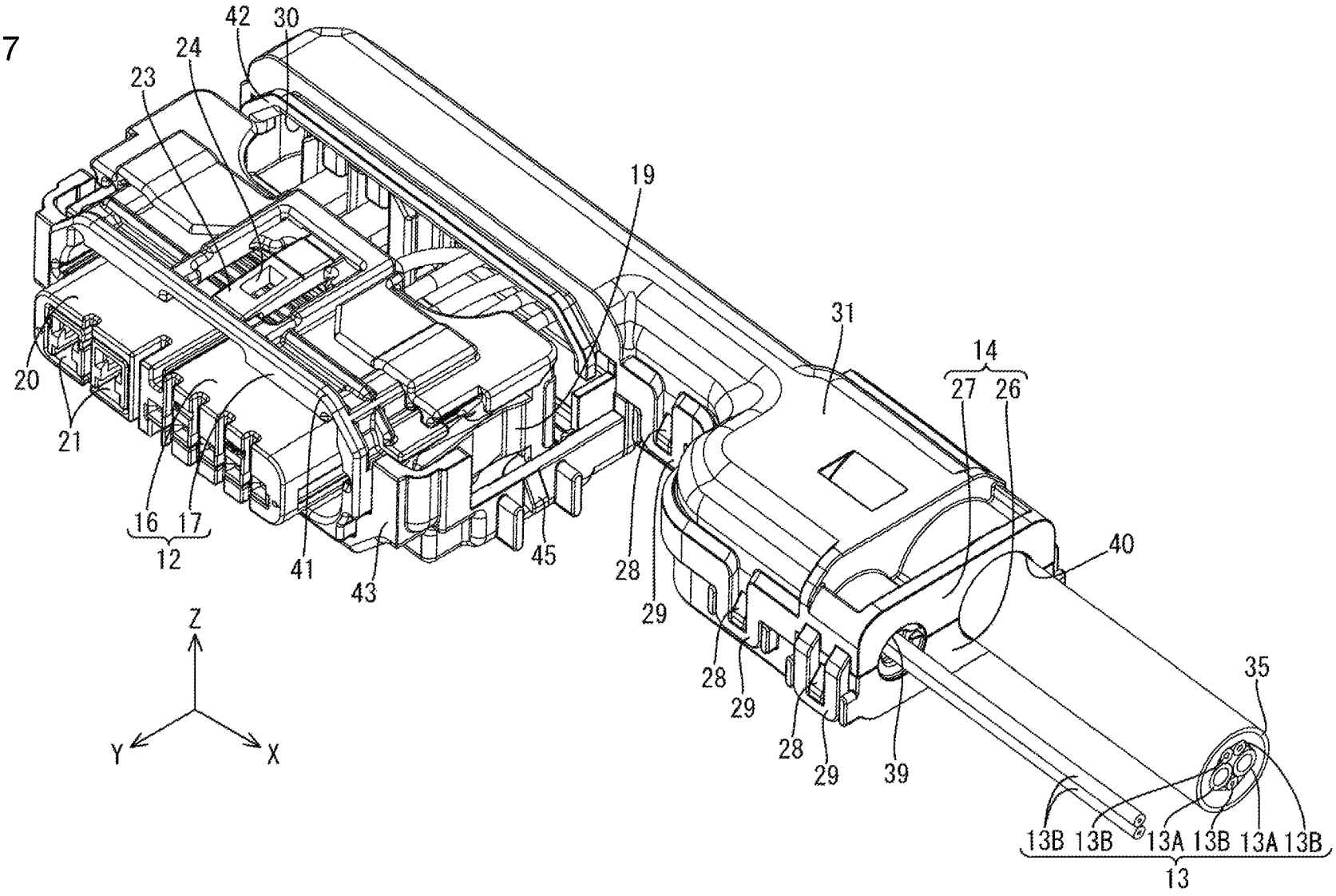
FIG. 7 is a perspective view showing the connector in a state where a second service cover is removed.
Figure 8:
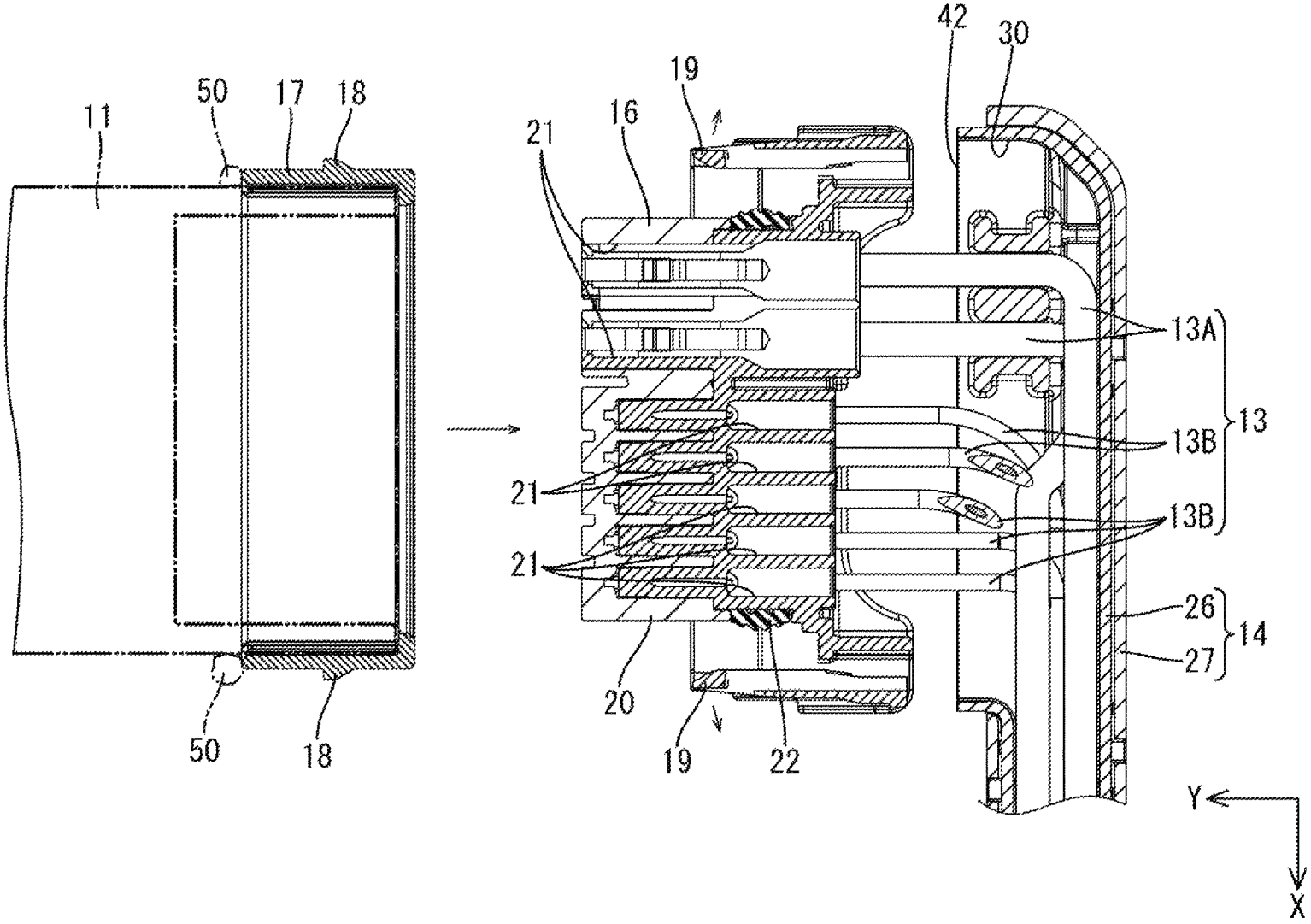
FIG. 8 is a partial enlarged section showing a state where an outer housing and an inner housing are separated.

First, the locking structure of the service cover locks 45 and service cover lock receiving portions 46 is unlocked to remove the second service cover 44 from the first service cover 43 (see FIG. 7). Then, the first locks 18 and the first lock receiving portions 19 are exposed. Further, a part of the rear end part of the connector housing 12 where the wires 13 are drawn out rearward is exposed.

The locking structure of the first locks 18 and the first lock receiving portions 19 is unlocked without separating the first service cover 43 from the outer housing 17. Subsequently, the inner housing 16 is pulled rearward, thereby being removed from the outer housing 17 (see FIG. 8).

In this way, the inner housing 16, the wires 13 drawn out from the terminal accommodating portion 20 of the inner housing 16 and the wire cover 14 covering the wires 13 are separated from the mating connector 11, the outer housing 17 and the first service cover 43.

At this time, since the mating connector 11 and the outer housing 17 are maintained in a fitting state, the external matter 50 adhering to the boundary part between the mating connector 11 and the outer housing 17 does not enter between the mating connector 11 and the outer housing 17.

Subsequently, the terminal to be repaired is pulled out from the terminal accommodating portion 20, and repaired.

After a repair operation is finished, the terminal connected to the end of the wire 13 is accommodated into the terminal accommodating portion 20.

The inner housing 16 is inserted into the outer housing 17 from behind. At this time, since the first service cover 43 and the outer housing 17 are not separated, the first service cover 43 can function as a guiding member for the inner housing 16 and suppress erroneous fitting of the inner housing 16 and the outer housing 17 (see FIG. 7).

The outer housing 17 and the inner housing 16 are locked by the first locking portions 18 and the first lock receiving portions 19. Thereafter, the second service cover 44 is assembled with the first service cover 43. In this way, the maintenance operation of the connector 10 is finished.

Functions and Effects of Embodiment

Next, functions and effects of this embodiment are described. The connector 10 according to this embodiment includes the connector housing 12 fittable to the mating connector 11, the wire cover 14 disposed at the position spaced apart rearward from the connector housing 12 in the fitting direction to the mating connector 11 and configured to cover the wires 13 drawn out rearward in the fitting direction from the connector housing 12, and the service cover 15 assembled over the connector housing 12 and the wire cover 14.

According to the above configuration, since the wire cover 14 is disposed at the position spaced apart rearward from the connector housing 12 in the fitting direction (front-rear direction), the part of the connector housing 12 where the wires 13 are drawn out can be exposed by removing the service cover 15 from the connector housing 12. In this way, it is possible to save time and effort of disassembling the wire cover 14 at the time of maintenance, and maintenance of the connector 10 can be improved.

Further, according to this embodiment, the connector housing 12 includes the inner housing 16 to be fit into the mating connector 11 and the outer housing 17 to be fit externally to the mating connector 11, and the outer housing 17 includes the first locks 18 to be locked to the inner housing 16 and the second lock 23 to be locked to the mating connector 11.

According this configuration, the following functions and effects can be achieved. First, the connector housing 12 is formed by locking the outer housing 17 and the inner housing 16 by the first locking portions 18. The connector housing 12 in this state and the mating connector 11 are fit. At this time, the mating connector 11 and the outer housing 17 are locked by the second locking portion 23, and the outer housing 17 is fit externally to the mating connector 11. Thus, the connector housing 12 and the mating connector 11 are fit.

Subsequently, during the maintenance operation, the first locking portions 18 of the outer housing 17 and the first lock receiving portions 19 of the inner housing 16 are unlocked from each other, and the inner housing 16 is separated from the mating connector 11 and the outer housing 17. In this way, the fitting state between the outer housing 17 and the mating connector 11 can be maintained also during the maintenance operation. This can suppress a performance reduction of the connector 10 due to the separation of the mating connector 11 from the outer housing 17. For example, it is possible to suppress the entrance of the external matter 50 adhering to the boundary part between the outer housing 17 and the mating connector 11 to move to the outer surface of the mating connector 11 or the inner surface of the outer housing 17 when the mating connector 11 is separated from the outer housing 17. Thus, a reduction in sealability between the mating connector 11 and the connector 10 can be suppressed. As a result, it is not necessary to pay attention to the performance reduction of the connector 10 during the maintenance operation, wherefore the efficiency of the maintenance operation of the connector 10 is improved.

After the repair operation is finished, the inner housing 16 is fit into the mating connector 11 and the inner housing 16 and the outer housing 17 are locked by the first locking portions 18. At this time, since the fitting state is maintained between the mating connector 11 and the outer housing 17, the performance reduction of the connector 10 can be reduced before and after the maintenance operation. For example, it is possible to suppress a movement of the external matter 50 adhering to the boundary part between the mating connector 11 and the outer housing 17 to the outer surface of the mating connector 11 or the inner surface of the outer housing 17. As a result, also when the connector housing 12 and the mating connector 11 are fit again, it is not necessary to pay attention to the performance reduction of the connector 10, wherefore the maintainability of the connector 10 can be improved.

The service cover 15 includes the first surrounding walls 47 for covering the first locks 18 with the service cover 15 assembled over the connector housing 12 and the wire cover 14. According to this configuration, external matter 50 cannot contact the first locks 18 to separate the inner housing 16 and the outer housing 17. On the other hand, the first locks 18 can be exposed easily by removing the service cover 15 during the maintenance operation. In this way, a worker can operate the first locks 18 to unlock the inner housing 16 and the outer housing 17 and to separate the inner housing 16 from the outer housing 17.

According to this embodiment, the service cover 15 includes the second surrounding wall 48 for covering the second lock 23 when the service cover 15 is assembled over the connector housing 12 and the wire cover 14, and the unlocking holes 49 penetrate through the second surrounding wall 48 to enable unlocking of the second lock 23. Thus, the locking structure of the mating connector 11 and the outer housing 17 can be unlocked without removing the service cover 15.

Further, this embodiment includes the water stop 51 with the rubber plug 32 having the wire through holes 33, through which the wires 13 are to be inserted, and the cap 37 to be fit externally to the rubber plug 32, and the water stop 51 is mounted in the wire cover 14. According to this configuration, the wires 13 can be sealed reliably in the wire cover 14. Further, sealing will not be reduced by contact of another member with the water stop 51.

The service cover 15 is formed by locking the service cover locks 45 on one of the first and second service covers 43, 44 and the service cover lock receiving portions 46 provided on the other to assemble the first and second service covers 43 and 44. According to this configuration, the service cover 15 easily can be removed from the connector housing 12 by unlocking the locking structure of the service cover locks 45 and the service cover lock receiving portions 46. In this way, the maintainability of the connector 10 can be further improved.

Second Embodiment

Figure 9:
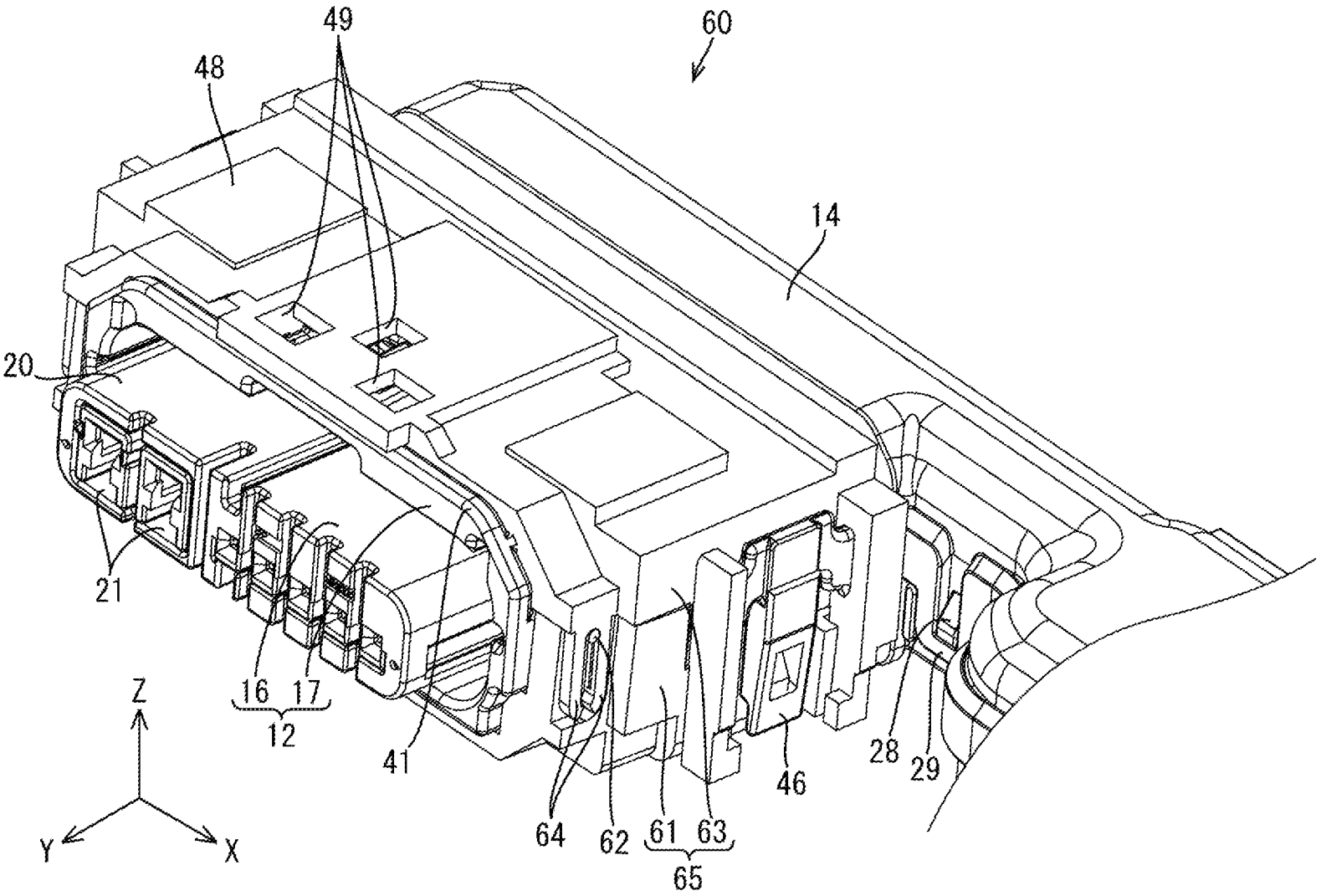
FIG. 9 is a partial enlarged perspective view showing a connector according to a second embodiment.

Next, a connector 60 according to a second embodiment is described with reference to FIGS. 9 to 11. As shown in FIG. 9, cylindrical shafts 62 projecting laterally outward are respectively provided at positions near front end parts of both left and right side walls of a first service cover 61 of a service cover 65.

Bearings 64 to be engaged with the shafts 62 from outside in radial directions of the shafts 62 are provided at positions near front end parts of both left and right walls of a service cover 63 and corresponding to the shafts 62. The bearing 64 extends down and is forked, and the forked part engages the shaft 62 by sandwiching the shaft 62 in the front-rear direction. An interval between forked sections in a front-rear direction of the bearing 64 is equal to or slightly lager than a diameter of the shaft 62. Further, lower end parts of the forked sections of the bearing 64 are bent toward each other, so that the shaft 62 is not easily separated from the bearing 64.

Figure 10:
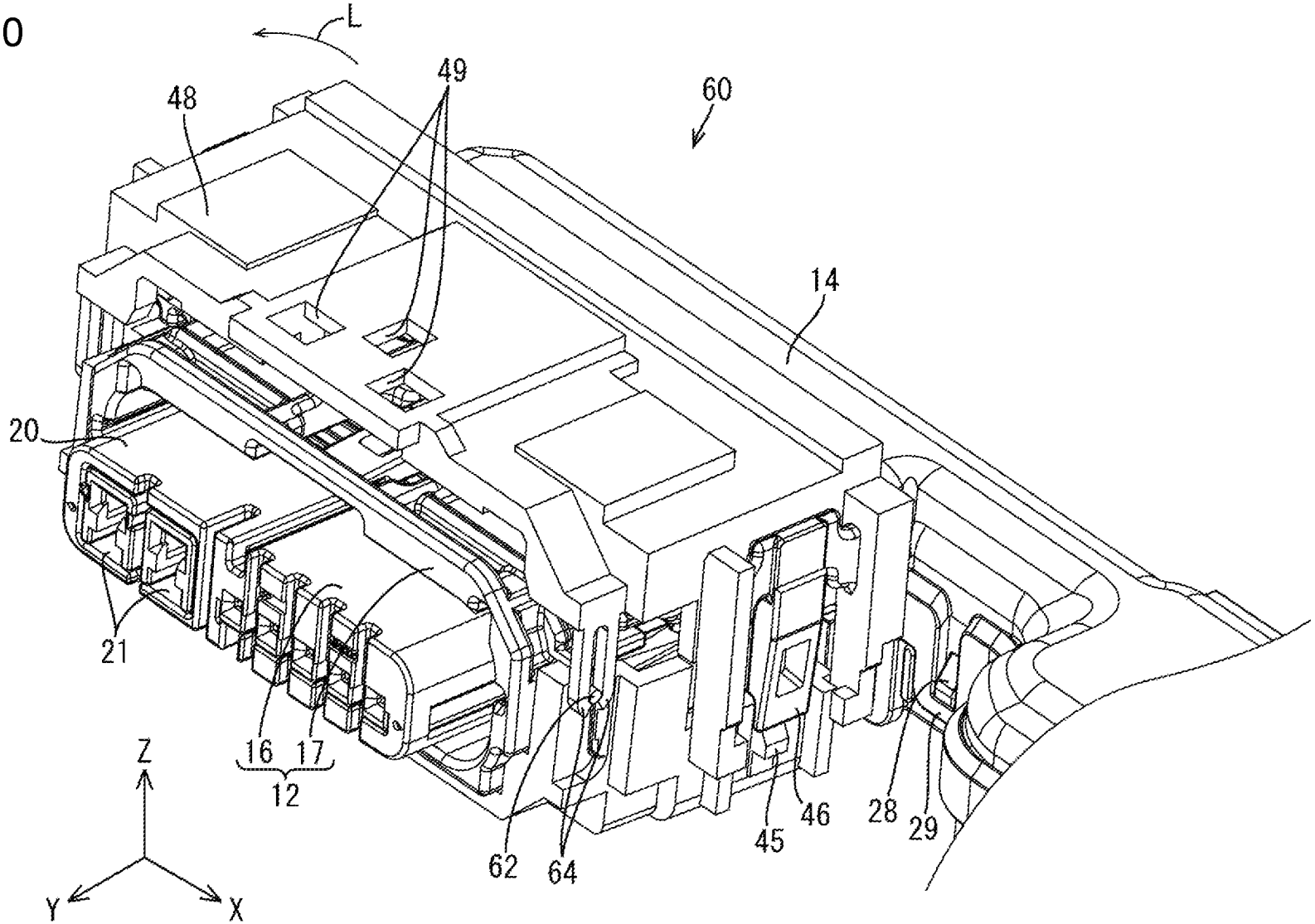
FIG. 10 is a partial enlarged perspective view showing a state where a second service cover is pulled upward after a locking structure of service cover locking portions and service cover lock receiving portions is unlocked.
Figure 11:
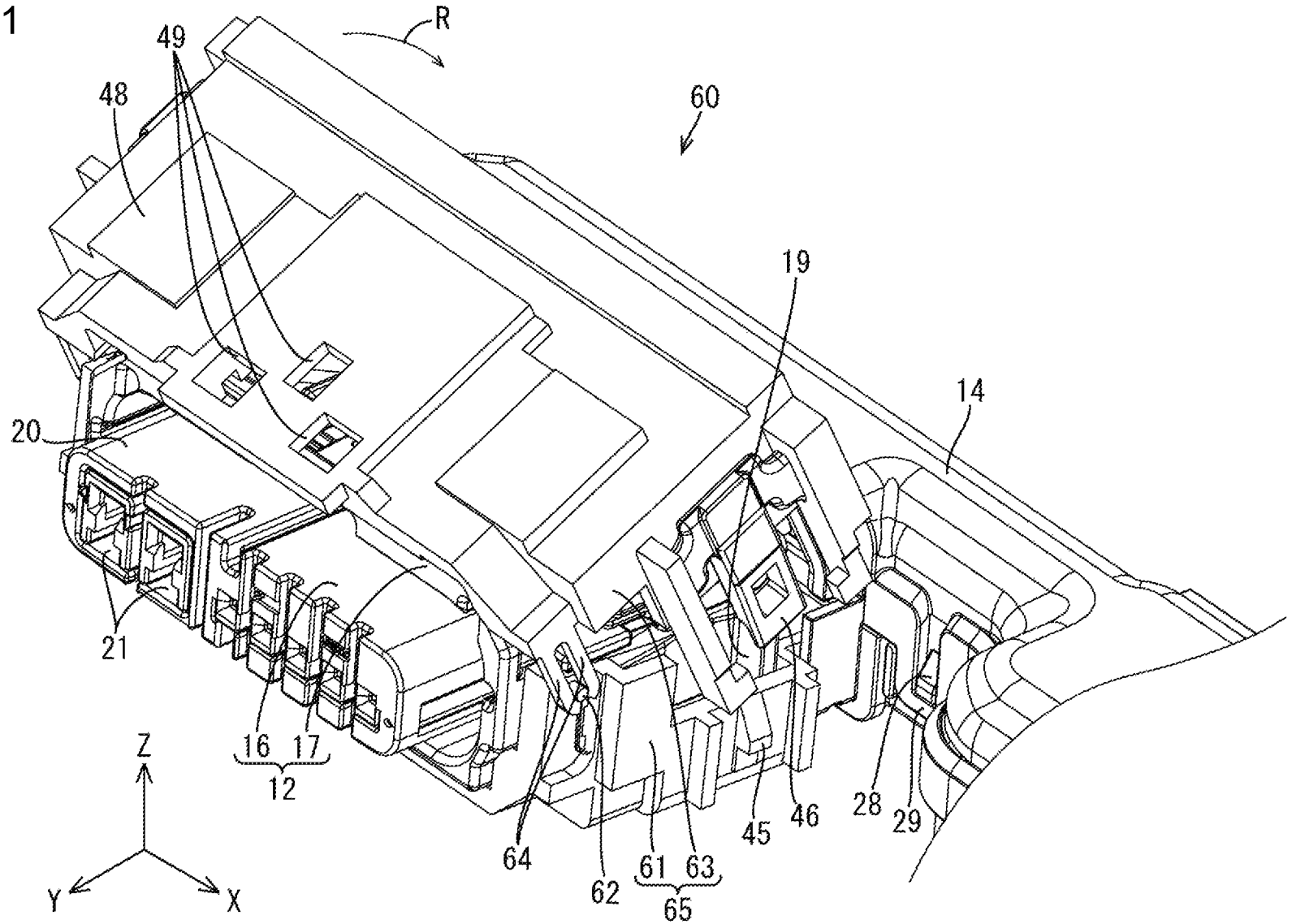
FIG. 11 is a partial enlarged perspective view showing a state where the second service cover is rotated in a direction indicated by an arrow L in FIG. 10.

As shown in FIGS. 10 and 11, the second service cover 63 is vertically movable by a vertical length of the bearings 64 with a locking structure of service cover locks 45 and service cover lock receiving portions 46 unlocked and with the shafts 62 sandwiched by the forked sections of the bearing 64. Further, in the above state, the second service cover 63 is rotatable about the shafts 62.

Since the configuration other than the above is substantially the same as in the first embodiment, the same members are denoted by the same reference signs and repeated description is omitted.

In the connector 60 according to this embodiment, a maintenance operation is performed, for example, as follows.

The locking structure of the service cover locks 45 and the service cover lock receiving portions 46 is unlocked. As shown in FIG. 10, the second service cover 63 is moved upward. Then, the shafts 62 move relatively down in the forked bearings 64. When the shafts 62 reach the lower parts of the bearings 64, downward movements of the shafts 62 are suppressed by tip parts of the bearings 64 formed to be narrow.

Subsequently, the second service cover 63 is rotated about the shafts 62 in a direction indicated by an arrow L in FIG. 10. Then, a gap between a rear end part of the first service cover 61 and a rear end part of the second service cover 63 is widened. In this way, first lockings 18 and first lock receiving portions 19 can be exposed to outside without separating the first and second service covers 61, 63.

A worker can separate an inner housing 16 from an outer housing 17 by operating the first lock receiving portions 19 to unlock the locking structure to the first locks 18.

After a terminal repair operation is finished, the inner housing 16 is assembled with the outer housing 17 from behind. At this time, since the first and second service covers 61, 63 remain on the outer housing 17 without being divided, the inner housing 16 is guided to the outer housing 17. In this way, erroneous fitting of the inner housing 16 and the outer housing 17 is suppressed after the end of the maintenance.

The second service cover 63 then is rotated about the shafts 62 in a direction indicated by arrow R in FIG. 11. After being rotated to a position shown in FIG. 10, the second service cover 63 is moved down. The second service cover 63 and the first service cover 61 are assembled by locking the service cover locks 45 and the service cover lock receiving portions 46 to finish the maintenance operation of the connector 60.

According to the above configuration, by rotating the second service cover 63 about the shafts 62 after the locking structure of the service cover locks 45 and the service cover lock receiving portions 46 is unlocked, a separating structure for separating a wire cover 14 from a connector housing 12 can be exposed. This eliminates a need for separating the first and second service covers 61, 63. Thus, components can be managed easily during maintenance. In this way, maintenance of the connector 60 is facilitated.

The invention is not limited to the above described and illustrated embodiments and, for example, can be embodied as follows.

Although the seal ring 22 is fit externally fit to the inner housing 16 in the first embodiment, the seal ring 22 may be fit internally to the mating connector 11. Further, in the case of use, for example, in an environment with a few external matters 50, the seal ring 22 may not be provided.

In the first embodiment, the number of the wires 13 drawn out from the connector 10 may be one to four, six or more.

Figure 12:
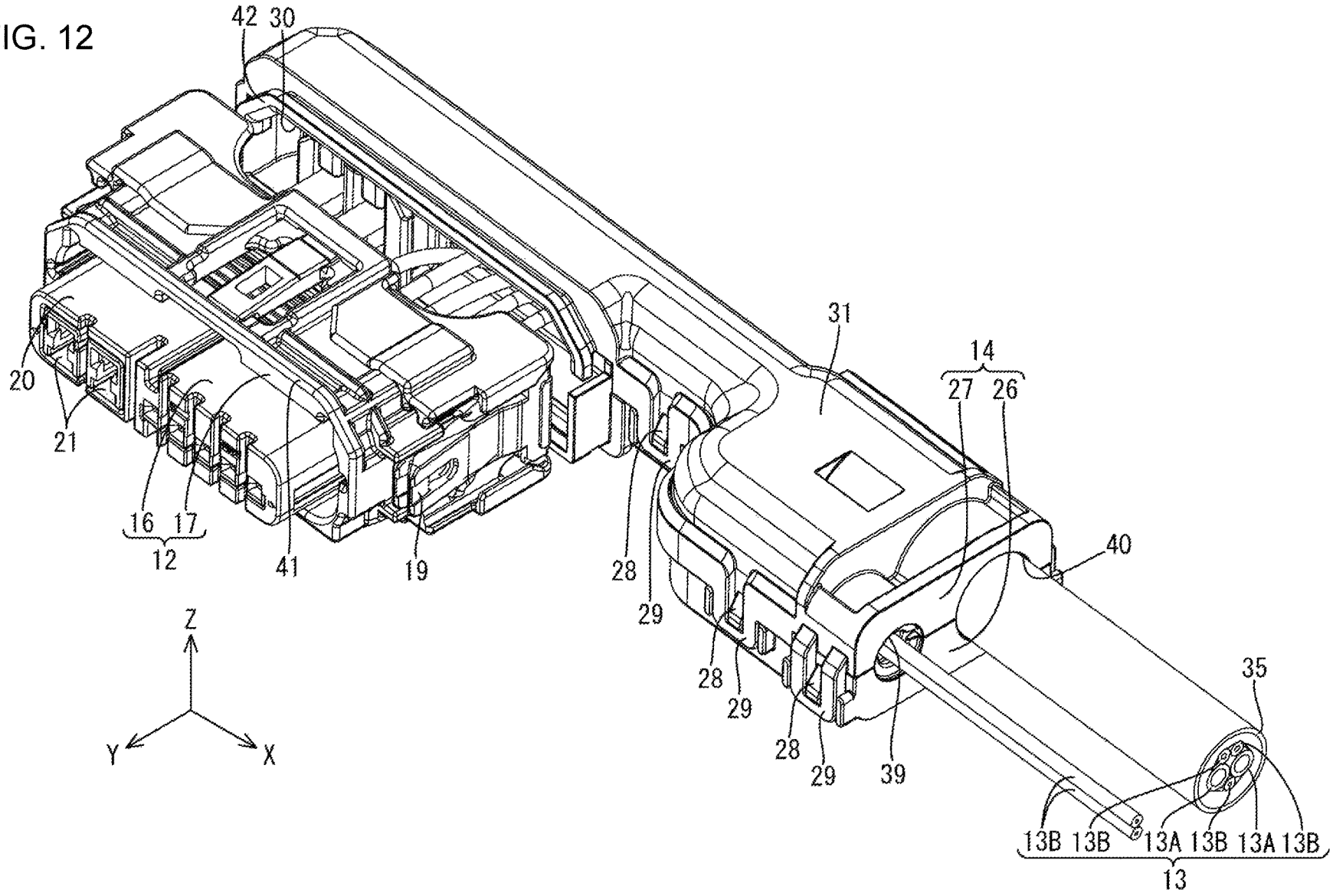
FIG. 12 is a perspective view showing a connector described in another embodiment (3) in a state where both a first service cover and a second service cover are removed.

In the first embodiment, the first service cover 43 may be also separated from the outer housing 17 as shown in FIG. 12, in addition to the second service cover 44, during the maintenance operation.

Although the service cover 15, 65 is configured by assembling two components, i.e. the first service cover 43, 61 and the second service cover 44, 63 in the first and second embodiments, there is no limitation to this and a service cover may be composed of one component or may be configured by assembling three or more components.

Although the service cover 15, 65 includes the unlocking holes 49 in the first and second embodiments, there is no limitation to this and the service cover 15, 65 may not include any unlocking hole 49.

The terminals accommodated in the terminal accommodating portions 20 of the connector 10 may be female terminals or may be male terminals.

The terminals accommodated in the terminal accommodating portions 20 of the connector 10 may be female terminals or may be male terminals.

Although the connector housing is configured by assembling two components, i.e. the inner housing and the outer housing, in the first and second embodiments, there is no limitation to this and a connector housing may be composed of one component

LIST OF REFERENCE SIGNS

10, 60: connector
11: mating connector
12: connector housing
13: wire
14: wire cover
15: service cover
16: inner housing
17: outer housing
18: first lock
23: second lock
32: rubber plug
33: wire through hole

37: cap
43: first service cover
47: first surrounding wall
48: second surrounding wall
49: unlocking hole
51: water stop
62: shaft
63: second service cover
64: bearing

What is claimed is:

1. A cover-equipped connector, comprising:

a connector housing configured to fit to a mating connector;

a terminal fitting fit in the connector housing;

a wire cover disposed at a position spaced apart rearward from the connector housing in a fitting direction to the mating connector and configured to cover a wire drawn out rearward in the fitting direction from the terminal fitting in the connector housing; and first and second service covers releasably assembled with one another over opposite sides of the connector housing and the wire cover so that the first and second service covers extend across a space between the spaced apart connector housing and the wire cover, the second service cover being removable from the first service cover and from both the connector housing and the wire cover for accessing the space between the connector housing and the wire cover to repair or replace the terminal fitting and the wire drawn out rearward from the terminal fitting.

2. The cover-equipped connector of claim 1, comprising:

a water stop including a rubber plug having a wire through hole, the wire being inserted through the wire through hole, and a cap to be externally fit to the rubber plug, wherein:

the water stop is mounted in the wire cover.

3. The cover-equipped connector of claim 1, wherein the service cover is formed by first and second service covers, the first service cover having a service cover locking portion and the second service covers having a service cover lock receiving portion, the service cover locking portion releasably engaging the service cover lock receiving portion to integrally assemble the first and second service covers.

4. The cover-equipped connector of claim 3, wherein:

a shaft projecting out on an outer wall of the first service cover; and the second service cover is provided with a bearing to be engaged with the shaft and is rotatable about the shaft with a locking structure of the service cover locking portion and the service cover lock receiving portion unlocked.

5. The cover-equipped connector of claim 1, wherein the connector housing includes an inner housing to be fit into the mating connector and an outer housing to be externally fit to the mating connector.

6. The cover-equipped connector of claim 5, wherein the connector housing includes an outer housing is separable from the inner housing when the second service cover is removed from the first service cover.

7. A cover-equipped connector comprising:

a connector housing configured to fit to a mating connector;

a wire cover disposed at a position spaced apart rearward from the connector housing in a fitting direction to the mating connector and configured to cover a wire drawn out rearward in the fitting direction from the connector housing; and a service cover assembled over the connector housing and the wire cover, wherein:

the connector housing includes an inner housing to be fit into the mating connector and an outer housing to be externally fit to the mating connector; and the outer housing includes a first lock to be locked to the inner housing and a second lock to be locked to the mating connector.

8. The cover-equipped connector of claim 7, wherein the service cover includes a first surrounding wall configured to cover the first lock with the service cover assembled over the connector housing and the wire cover.

9. The cover-equipped connector of claim 7, wherein:

the service cover includes a second surrounding wall configured to cover the second lock with the service cover assembled over the connector housing and the wire cover; and an unlocking hole penetrates through the second surrounding wall and enabling the second lock to be unlocked.

* * * * *